US005855535A

United States Patent [19]

Shafer

[11] Patent Number: 5,855,535

[45] Date of Patent: Jan. 5, 1999

[54] JAW MUSCLE EXERCISE DEVICE

[76] Inventor: Eugene P. Shafer, 7373 Atoll Ave., Unit C, North Hollywood, Calif. 91605

[21] Appl. No.: 764,135

[22] Filed: Dec. 12, 1996

[51] Int. Cl.[6] ..... A63B 23/03; A63B 21/02

[52] U.S. Cl. ..... 482/11; 482/121; 128/861

[58] Field of Search ..... 482/10, 11, 121, 482/148, 908; 601/38; 128/848, 777, 859, 860, 861; 600/590; 73/379.02, 379.03

[56] References Cited

U.S. PATENT DOCUMENTS

| | | | |
|---|---|---|---|
| 1,953,088 | 4/1934 | Purdy | 482/11 |
| 2,521,039 | 9/1950 | Carpenter | 128/861 |
| 2,590,118 | 3/1952 | Oddo, Jr. | 128/861 |
| 3,217,708 | 11/1965 | Roberts | 128/861 |
| 3,295,519 | 1/1967 | Gerber | 128/862 |
| 3,525,520 | 8/1970 | Dwyer | 482/11 |
| 4,185,817 | 1/1980 | Peterson | 128/861 |
| 4,425,911 | 1/1984 | Luomanen et al. | 128/862 |
| 4,920,984 | 5/1990 | Furumichi et al. | 128/861 |
| 4,955,393 | 9/1990 | Adell | 128/859 |
| 5,487,660 | 1/1996 | Good | 433/93 |
| 5,556,357 | 9/1996 | Hanna | 482/11 |

*Primary Examiner*—Richard J. Apley
*Assistant Examiner*—Victor K. Hwang
*Attorney, Agent, or Firm*—Blakely Sokoloff Taylor & Zafman LLP

[57] ABSTRACT

A compact jaw muscle exercise device that people use to strengthen and tone jaw muscles which includes a generally wedged shape body of plastic having upper and lower surfaces adapted to engage one's teeth. Holes run transversely through the body, which increases the deformability of the exercise device. The exercise device's resistance may be increased by inserting cylindrical members through the holes.

6 Claims, 1 Drawing Sheet

FIG. 1
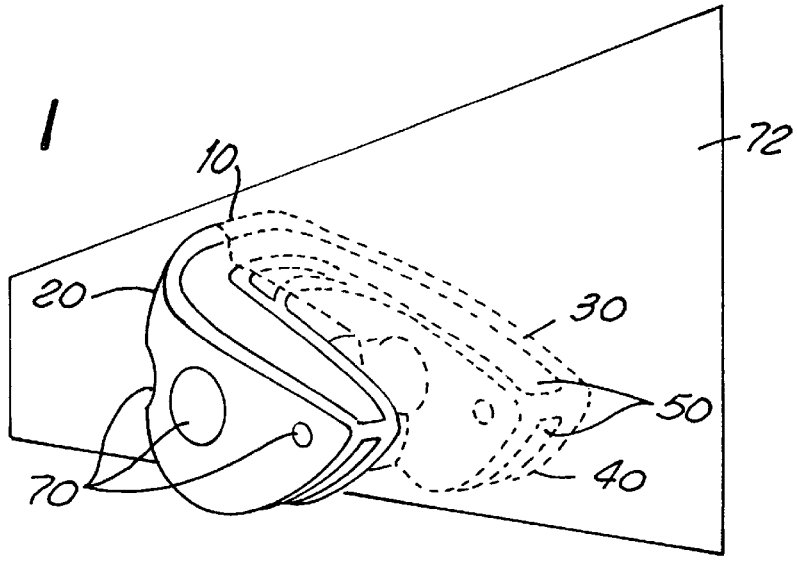
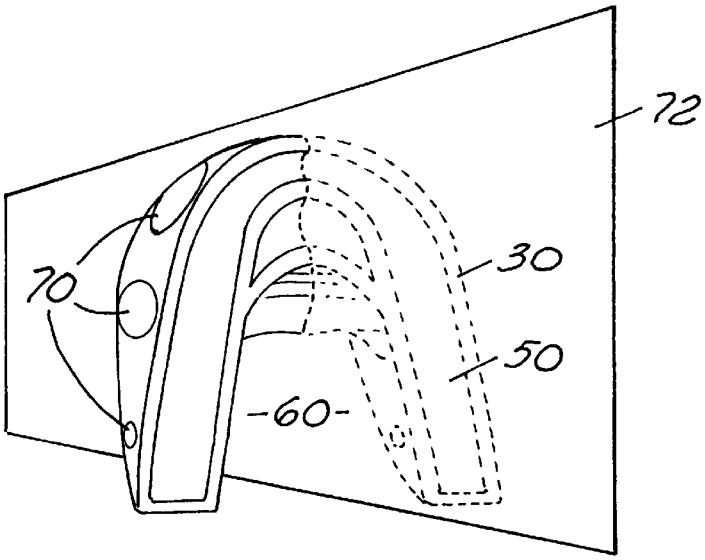
FIG. 2
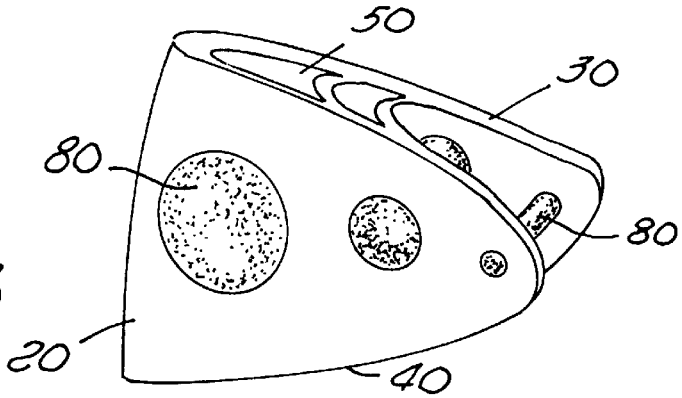
FIG. 3

JAW MUSCLE EXERCISE DEVICE

BACKGROUND OF THE INVENTION

Field of the Invention

The present invention relates generally to the human muscle exercise apparatus and, more specifically, to an exercise device for muscles in the jaw area to strengthen and tone these muscles.

Because of the location of the jaw muscles, it is difficult to target these muscles with exercisers. Since the exerciser will be in use in or around one's mouth, it is important that the device not obstruct the user's air flow. Therefore, it is desirable to provide a compact device for exercising one's jaw muscles which allows the user to target the muscles.

SUMMARY OF THE INVENTION

The present invention involves a device for exercising one's jaw muscles. More specifically, the invention includes a generally wedge-shaped device, sized to fit in a human's mouth, with upper and lower surfaces adapted to engage one's teeth. The device is of a resilient material which imparts resistance when compressive waves are applied to the device through repetitive chewing motions of the user.

In one embodiment of the invention, the device has holes which run transversely through the body of the device. The holes increase the deformability of the device when under compressive waves. Cylindrical inserts can be placed in the holes to increase the resistance. By varying the density of the material used for the cylindrical inserts, the user can control the resistance of the device.

It will be appreciated from the forgoing that the present invention represents an advance in the field of jaw muscle exercisers. The present invention provides for a compact device for exercising one's jaw muscles. The user may vary the resistance of the device to the user's desired level. Other aspects and advantages of the invention will become apparent from the following more detailed description, taken in conjunction with the accompanying drawings.

BRIEF DESCRIPTION OF THE DRAWINGS

FIG. 1 is a side perspective view of a jaw muscle exercise device;

FIG. 2 is a top perspective view of a jaw muscle exercise device showing the displaced area for the user's tongue, and the holes; and FIG. 3 is a side perspective view of a jaw muscle exercise device showing the hole, with the resistance members sleeves placed in the hole.

DETAILED DESCRIPTION

As shown in FIG. 1, an exemplary jaw muscle exercise device 10 includes a generally wedged shape body 20, capable of fitting into a human's mouth. The body has an upper surface 30 and a lower surface 40, each surface being adapted to engage one's teeth. The surfaces may be adapted in many ways to engage one's teeth. For example, the surfaces may include general dental impressions that align with one's teeth. However, it is preferred that upper surface 30 and lower surface 40 have a groove 50 adapted to engage one's teeth. Groove 50 is not specific to one dental pattern, and thus device 10 can be used by different users with different dental formations.

As shown in FIG. 2, body 20 also has a displaced area 60 which accommodates the user's tongue when the device is in place. The device is used by inserting the body into one's mouth, and aligning groove 50 with one's teeth. The user then bites down on the device, causing the device to compress under the force. The resistance of the device to the compressive force is imparted to the jaw muscles of the user.

In one embodiment, as shown in FIGS. 1 and 2, holes 70 run transversely through body 20, thereby decreasing the overall resistance of the device. The axis of each of the holes 70 is transverse to an imaginary central vertical plane 72 which bisects the body 20 of the device 10. The portion of the device 10 behind the imaginary plane 72 are shown in phantom lines. As illustrated in FIG. 3, resistance members 80 are inserted into the holes to increase the resistance of the device to compressive forces. The members may be of tubular shape. It is preferred that the members be cylindrical and fit snugly into the holes, so that when the device is in use, the members do not shift or slide out of the holes, causing discomfort to the user.

Device 10 is made of an elastomer material, such as urethane plastic. It is preferred that it be made of a plastic material sold under the name Javon, manufactured by Dow Chemical Corporation of Midland, Mich. which provides a sufficient level of resistance as well as resiliency. Further, the material has been approved by the Federal Department of Agriculture for use in devices to be placed in the mouth. The plastic chosen is lightweight, inexpensive and has a good resiliency. Moreover, as the plastic does not have an aftertaste to most individuals, it is a less offensive material to introduce into one's mouth.

Resistance members 80 is made of the same material. By varying the thickness of the material of the inserts, the user may vary the resistance of the device. It is preferred that the inserts be made of urethane tubing, since such tubing has a desired resiliency and elasticity, and is readily available.

It is appreciated that other modifications and variations of the apparatus might be made by those skilled in the art without departing from the spirit and scope of the present invention.

What is claimed is:

1. A jaw muscle exercise device, comprising:

a generally wedge-shaped unitary resilient body with upper and lower surfaces forming the faces of the wedge, which is sized and configured to fit within a human mouth, the surfaces being adapted to engage the teeth of the user, the resilient body having a plurality of holes extending through the body between the upper and lower surfaces with the axis of each hole being transverse to a central vertical plane bisecting the body, and a resistance member positioned in at least one of the holes, whereby, when a user inserts the device into the mouth and bites down repetitively on the upper and lower surfaces of the resilient body, the resistance to deformity of the resilient body is imported to the jaw muscles of the user.

2. A jaw muscle exercise device as defined in claim 1, wherein:

the resistance member is composed of an elastomer which has a resistance to the deformation of the body when compressive forces are applied.

3. A jaw muscle exercise device as defined in claim 1, wherein:

the resilient body is composed of an elastomer which has a resistance to the deformation of the body when compressive forces are applied to the upper and lower surfaces.

4. A jaw muscle exercise device as defined in claim 1, wherein:

the upper and lower surfaces have grooves for engaging the user's teeth.

5. A jaw muscle exercise device as defined in claim 1 wherein:

the unitary body has a displaced section for accommodating the user's tongue.

6. A method for exercising one's jaw muscles comprising the steps of:

inserting into one's mouth a jaw muscle exercise device comprising a generally wedge-shaped unitary resilient body with upper and lower surfaces which form the faces of the wedge and which are adapted to engage the teeth of the user, the body having a plurality of holes which run through the body between the upper and lower surfaces with the axis of each hole being transverse to a central vertical plane bisecting the body and a resistance member positioned in at least one of the holes; and repetitively biting down on the jaw muscle exercise device, whereby the resistance to deformity of the resilient body is repetitively imparted to one's jaw muscles.

* * * * *